US005881837A

United States Patent [19]

Leicht

[11] Patent Number: 5,881,837

[45] Date of Patent: Mar. 16, 1999

[54] TREE CLIMBER STEP ASSEMBLY

[76] Inventor: Frank Leicht, 4517 W. Grove, Skokie, Ill. 60076

[21] Appl. No.: 944,575

[22] Filed: Oct. 6, 1997

[51] Int. Cl.[6] ..... E04G 3/00

[52] U.S. Cl. ..... 182/92; 182/90

[58] Field of Search ..... 182/92

[56] References Cited

U.S. PATENT DOCUMENTS 5,624,007 4/1997 Mahaffy ..... 182/92

*Primary Examiner*—Daniel P. Stodola
*Assistant Examiner*—Hugh B. Thompson
*Attorney, Agent, or Firm*—Paul H. Gallagher

[57] ABSTRACT

The device includes a step and a handle as separate units. The step is made of two steel rods welded together, and having a threaded screw at one end to be driven into a tree. The user detachably attaches the handle to the step, and by swinging the handle, thrusts or throws the step against the tree, starting the screw into the tree, and then turns the handle to drive the step entirely into fully secured position into the tree. The user then detaches the handle from the step and repeats the maneuver with additional steps.

14 Claims, 3 Drawing Sheets

TREE CLIMBER STEP ASSEMBLY

SUMMARY OF THE INVENTION

The device includes a step that is secured to a tree, along with other steps, and a handle that is detachably connectible with the step for manually turning the step into the tree.

The step and the handle constitute an assembly, and when the handle is mounted on the step, the entire assembly is manipulated by the user for first thrusting the step into the tree to a starting position and then the handle is used for turning and screw-threading the step farther into the tree to a secure position, the handle acting as a crank for that purpose.

A principal object of the invention is to provide such a step that is extremely strong, and extremely simple in construction. The step includes a threaded screw point which forms an extension of a strong element of the complete step, and thus provides great securement with the tree, and is of great strength to hold a great weight.

The assembly is such that a great number of steps can be carried by the tree climber, and a single handle. The handle, as mentioned, is detachably connectible with the step, and it is used for successively mounting the steps in the tree.

The handle also is of extreme simplicity, and strength and can be detachably connected with the step, and disconnected therefrom, by a very simple maneuver. After a number of steps have been mounted in the tree, and used by the user, the handle is again used for removing them, at any time later. In a hunting season, for example, they may be left in a tree for a month or two months.

The quick-attachable handle is efficient in use, in that, in installing a number of steps in a tree, the handle can be quickly attached to the step, and the step driven into the tree, and then the handle again detached, in a minimum of time, so as to facilitate the overall operation of installing a number of steps.

Another feature is that the step includes a bar for hooking a safety belt thereon.

BRIEF DESCRIPTION OF THE INDIVIDUAL FIGURES OF THE DRAWINGS

DETAILED DESCRIPTION OF THE DRAWINGS

Figure 1:
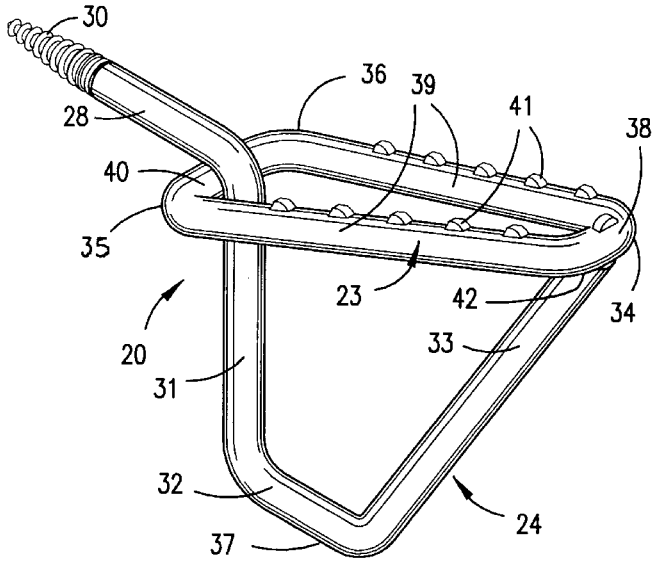
FIG. 1 is a perspective view of the step of the invention.
Figure 2:
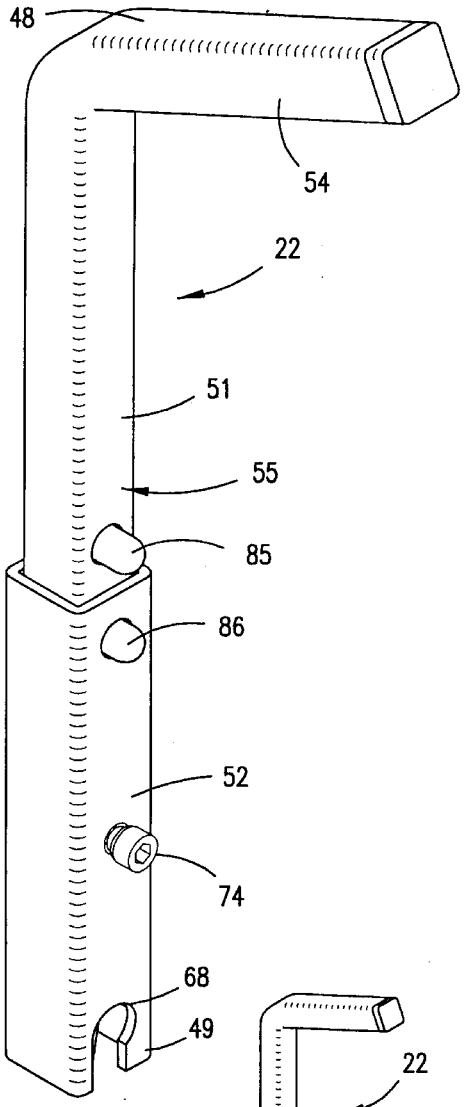
FIG. 2 is a perspective view of the handle.
Figure 3:
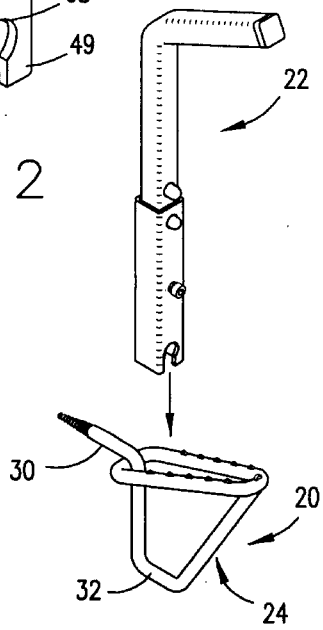
FIG. 3 is a view of the step and handle indicating how the handle is connected to the step.
Figure 4:
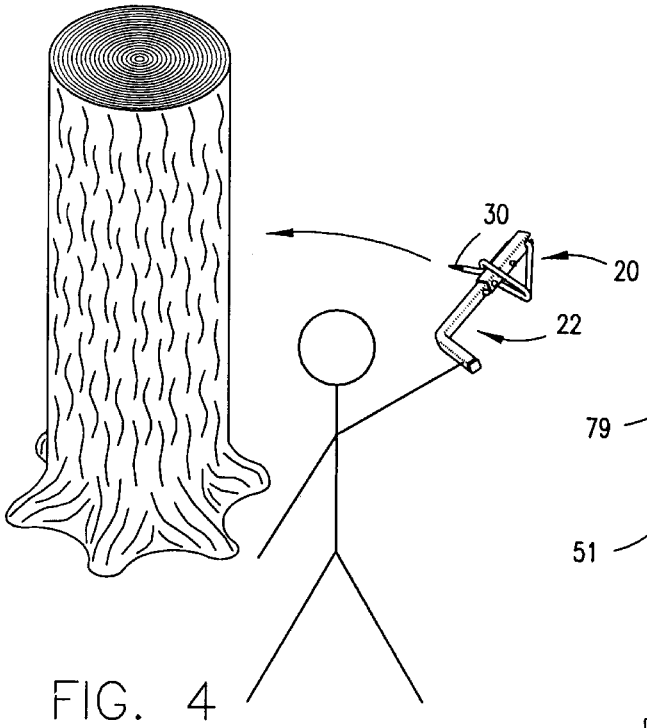
FIG. 4 is a diagrammatic view of how the step is started into the tree.

FIG. 1 is a perspective view of the step 20 of the device and FIG. 2 is a perspective view of the handle 22 used for turning or cranking the step into full secure position in the tree. The interconnection between the handle and the step is shown and indicated in FIGS. 3–5.

For convenience, the device is described as oriented when mounted in the tree (FIG. 5), thus having upper and lower elements, inner and outer elements, etc., as referred to in detail hereinbelow. In such position, the step in its entirety, has an inner end 35 (see also FIG. 1), an outer end 34, an upper end 36 and a lower end 37.

Referring to the step 20 in detail, which may also be referred to as a step unit, this step includes a top tread member 23 and a bottom frame member 24. The frame member is a single, integral, continuous steel rod, bent to a particular shape for its use in the step. The rod making up the frame member includes a first segment 28 which is in the form of a taper point wood screw 30. The frame member includes a vertical or upright second segment 31 which is positioned perpendicular to the screw 30. It includes a third segment 32 extending generally horizontally, and of short length, and a fourth segment 33 positioned in a diagonal direction.

Figure 6:
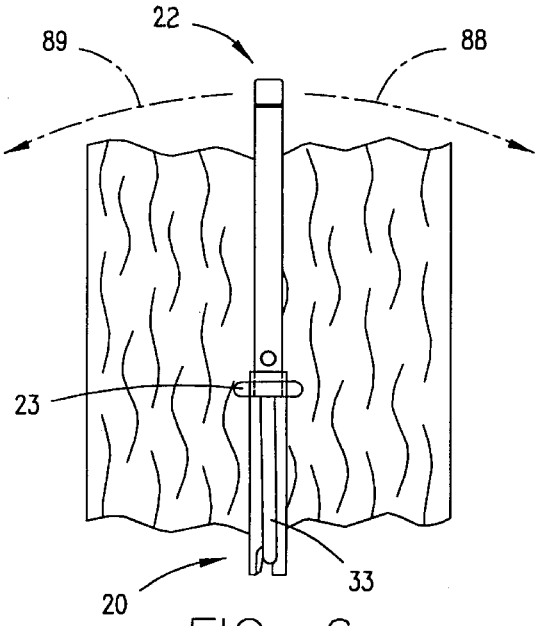
FIG. 6 is a view taken from the right of FIG. 5 indicating the handle being used as a crank.

The frame member 24 when it is in position secured in the tree, as referred to above, lies essentially in a vertical plane (FIG. 6). This frame, constituting a single length of rod, bent into final shape, is of great strength, being made up of for example 8620 steel. When the step is mounted in the tree, the screw 30 is adjacent the horizontal, but not necessarily in that position. The second segment 31 is inclined forwardly in downward direction a slight amount.

The tread member 23 is in the shape of a loop, having a rounded outer end 38, straight side elements 39, and inturned elements 40 at its front end. It preferably inclines upwardly in outward direction, at a small angle. The side elements 39 straddle the plane of the frame member. The tread member is provided with anti-slip projections 41 in its upper surface, which may be punched out of the material, for engagement by the foot of the climber. The tread member is also preferably of round rod material, but need not be as strong steel as is the frame member 24, and may for example be of 1008 steel.

Figure 7:
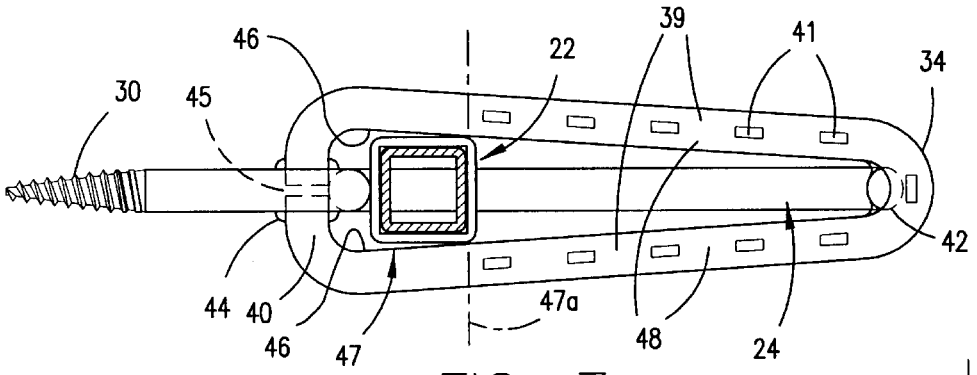
FIG. 7 is a view taken at line 7—7 of FIG. 5.

The tread member is welded to the frame member at an outer point 42 (FIGS. 1, 7). The inturned elements 40 are positioned inwardly of the vertical segment 31 and welded thereto at 44. The inturned elements 40 are spaced apart (FIG. 7) forming a gap 45, and the weld at 44 fills this gap and engages both the tread member and the frame member.

The side elements 39 of the tread member are so shaped and spaced as to have parallel portions 46 at the front end, (FIG. 7) forming a square space 47, terminating at the vertical line 47*a*, and outwardly converging portions 48. The square space receives the lower end of the handle 22 (FIGS. 5, 7) while the portions at 48 serve as a limiting stop against the movement of the handle in corresponding direction, i.e. outwardly.

Figure 5:
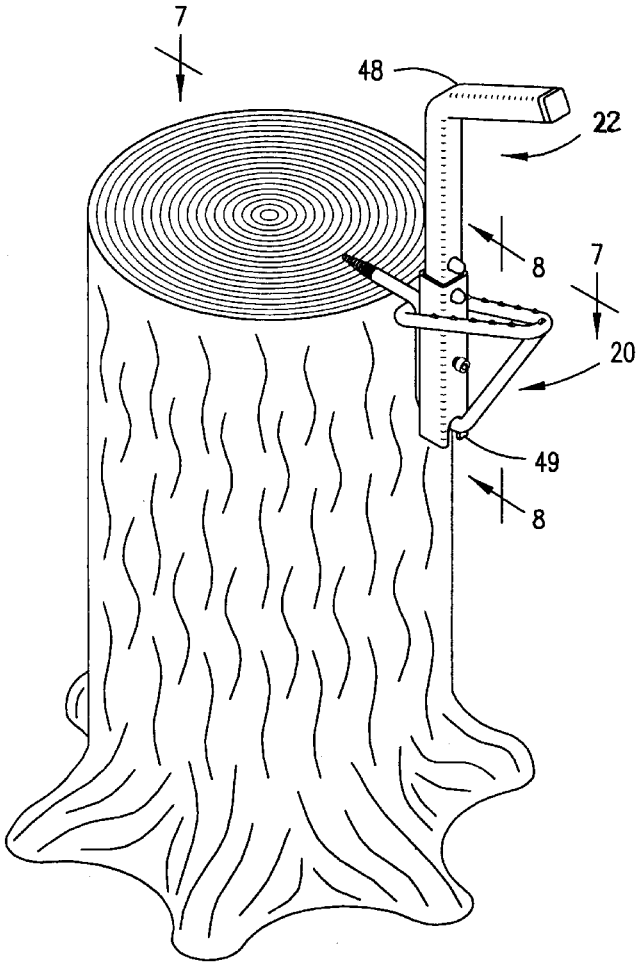
FIG. 5 is a perspective view of the step fully mounted in the tree, and the handle applied to the step.

In the use of the entire assembly, the handle is inserted downwardly through the square space 47 (FIG. 3), and its lower end engages the third segment 32, as shown in FIG. 5, and as described fully hereinbelow.

Referring specifically to the handle 22, this member is described as oriented complementally to the step, and in such position is arranged vertically (FIG. 5) and thus has an upper end 48 and a lower end 49. The handle member is made up of two main components, namely an inner bar or shank 51 (FIG. 2) and an outer sleeve 52 telescoped on the lower end of the bar. The handle at its upper end is bent to form a transverse hand grip 54. In mounting the step in the tree, the handle 22 is used as a crank, and may be so referred to, and it also may be referred to as an installation wrench. The inner bar and sleeve are preferably square in cross section to accommodate rotational interlocking, and interacting functions.

Figure 9:
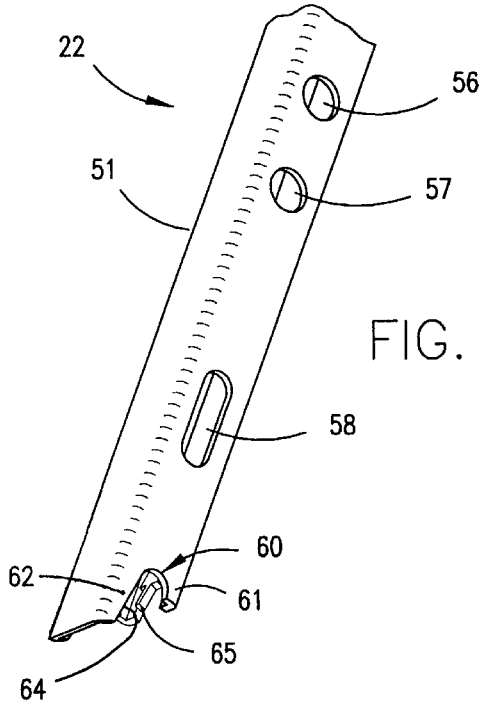
FIG. 9 is a perspective view of the lower end of the handle, without the outer sleeve.

Referring to the main bar 51, its lower end is shown in perspective in FIG. 9 and the side most in view is as oriented according to the arrow 55 in FIG. 2. It will be seen that it has longitudinally spaced round apertures 56, 57, and below the latter, an elongated slot 58. At the bottom, the bar 51 has a notch 60 extending through opposite walls, and having on one side a short finger 61, and on the other side a relatively long finger 62. On the finger 62 is an inclined surface 64. On the finger 61 is a tab 64 for hooking a tension spring thereon, referred to below.

Figure 8:
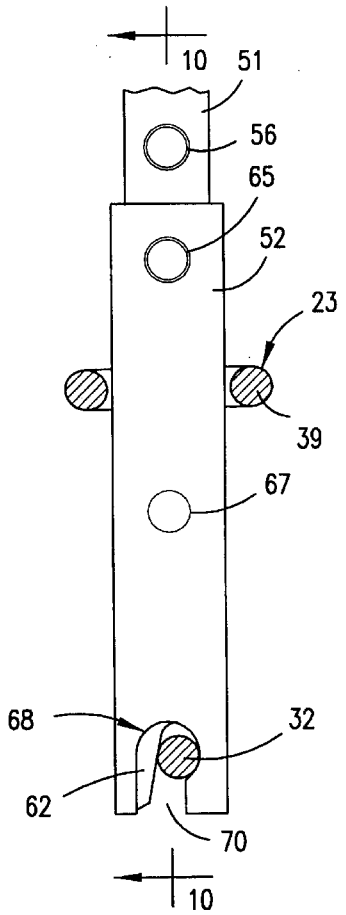
FIG. 8 is a view taken at line 8—8 of FIG. 5.

The outer sleeve 52 (FIGS. 2, 10, 11) has an aperture 65 (FIG. 8) and a second aperture 67 below the aperture 65.

Figure 13:
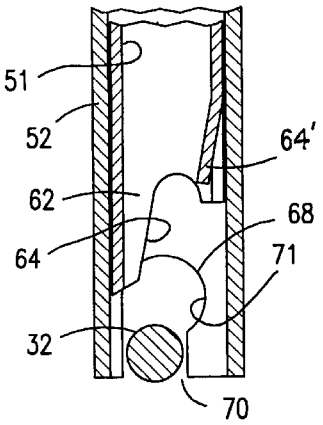
FIG. 13 is a view taken at line 13—13 of FIG. 10, showing the parts of the handle in non-locking position and showing a rod element of the step entering into the slot in the handle.
Figure 14:
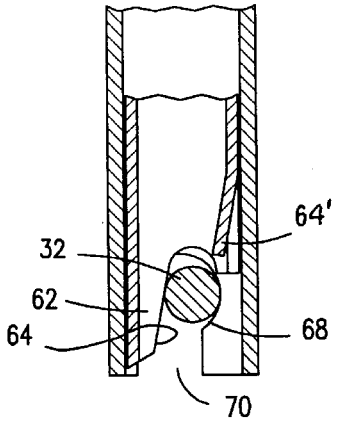
FIG. 14 is a view similar to FIG. 13 but with the parts of the handle in locking position and the rod element of the step fully into the slot.
Figure 12:
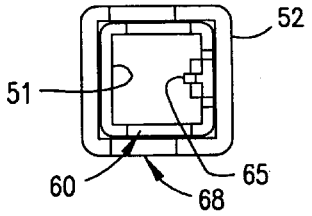
FIG. 12 is an end view from the bottom of FIG. 10.

At the bottom, the outer sleeve 52 has a notch 68 (FIGS. 8, 13, 14) extending through the opposite side walls, having a lower inlet portion 70 which is relatively narrow, and a larger inner or upper portion 71.

A thumb screw 74 (FIGS. 2, 10, 11) is threaded in the aperture 67 (FIG. 8) and has a stem 76 extending through the slot 58 (FIGS. 9, 10, 11) into the interior of the main bar 51.

Figure 10:
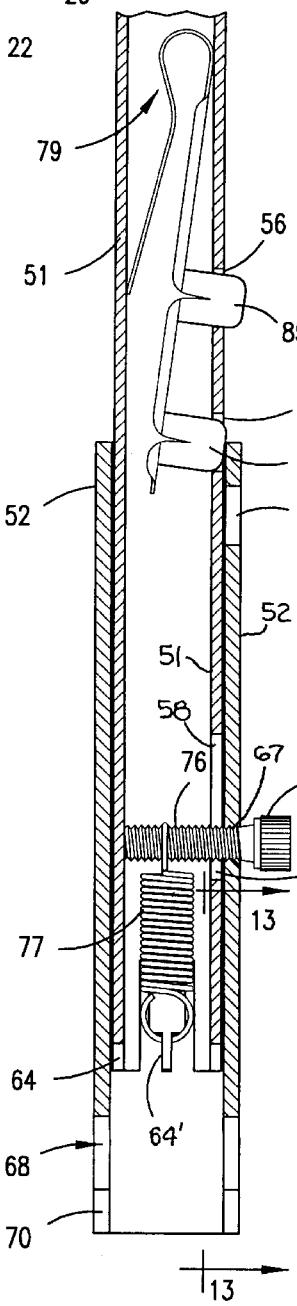
FIG. 10 is a sectional view taken at line 10—10 of FIG. 8 showing the parts of the handle in retracted, unlocked position.
Figure 11:
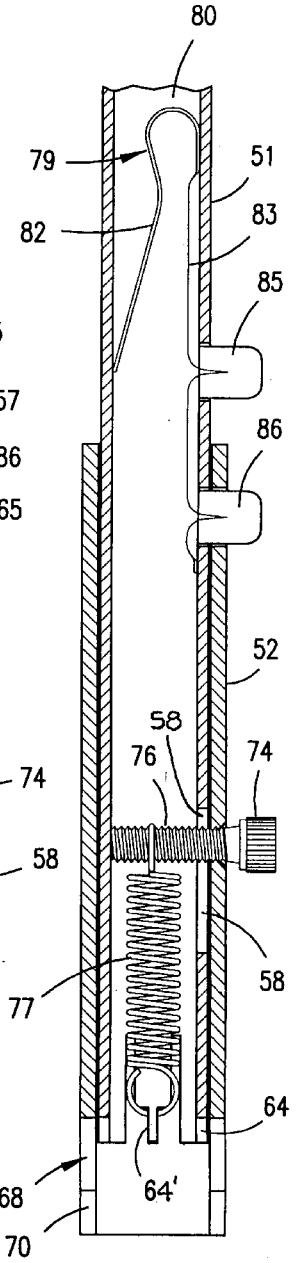
FIG. 11 is a view similar to FIG. 10 but showing the parts in locked position.

A tension spring 77 (FIGS. 10, 11) is connected between the stem 76 and the tab 65 (FIG. 9). This spring biases the outer sleeve downwardly relative to the main bar 51 to non-latching, or inactive, position (FIG. 10). In this position the lower end of the outer sleeve extends below the lower end of the main bar 51.

Contained within the main bar 51 is a double snap button clip 79 (FIGS. 10, 11) made of a single piece of spring steel bent in U-shape, or hairpin shape, having a closed end 80, and a pair of arms 82, 83. The arm 83 may be longer than the other arm, and has a pair of pushbuttons 85, 86, stamped from the original spring steel piece. The pushbuttons may also be referred to as a control pushbutton and a latch pushbutton respectively.

The clip 79 is positioned in the interior of the main bar, and the buttons are positioned for extension into and through the apertures 56, 57, 65 respectively. The clip is so positioned with the loop end 80 extending upwardly, or toward the end 48 of the handle, and the arms extending downwardly, and it is held in place longitudinally by the buttons extending through the apertures, the clip being free of other securement in position.

In the beginning, in the phase of mounting the step in the tree, the step is considered as a separate item, and one of many to be so mounted. In this phase, the step is held in one hand (e.g. left hand) and the lower end of the handle (FIG. 3) is inserted downwardly through the tread member and into engagement with the third segment 32 of the frame member. In this maneuver, the segment 32 is received in the notch 68 in the sleeve, and in this position the finger 62 (FIGS. 13, 14) is retracted (upwardly) from the lower end of the outer sleeve, or relatively speaking, the sleeve is projected below the lower end of the main bar. In such position, the finger 62 (FIG. 13) is retracted from lower end 70 of the notch 68, and the rod segment 32 is enabled to pass through the small part 70 of the notch, the notch being dimensioned for that purpose. Upon further movement, the segment 32 engages the inner, closed end of the notch, to a limit position. Upon further downward thrust of the handle, which results in movement of the inner bar relative to the outer sleeve, the lower end of the inner bar works against the tension spring 77 (FIGS. 10, 11), and this results in upward movement of the sleeve, relative to the downward movement of the handle. This upward movement of the sleeve positions the upper aperture 65 (FIGS. 8, 10), in line with the button 86, and the button is thrust outwardly through the apertures 65, 57 and thus locks the main bar and outer sleeve in position longitudinally. In this relative movement, the finger 62 moves from the retracted position of FIG. 13 to the projected or locking position of FIG. 14. The wedge surface or inclined surface 64 pushes the rod segment 32 to the side, into the large part of the notch, and constricts the open portion 70 (FIG. 8) to a dimension less than the diameter of the rod segment, thus preventing the latter from moving forwardly out of the notch. In this description, the movements referred to, may be opposite, or correlative, and instead of one element moving as stated, it may be the opposite element that moves, and this refers to the element of the handle and of the frame member, e.g. rod segment 32.

The upper button 85 remains always accessible to the thumb, but as to the lower button 86, in the retracted position of the handle, that button is held inwardly by the upper end of the outer sleeve. As will be obvious, to condition the wrench from locking position (FIG. 11) to unlocking position (FIG. 10) the user presses the upper button 85, which retracts the lower button 86 from the apertures, and the coil spring 77 acts to pull the main bar upwardly, and the outer sleeve downwardly, relatively speaking, holding the handle in non-locking or unlatching position.

When the handle member is latched or locked to the step as shown in FIG. 5, the user grasps the main bar 51 and swings the lower end, or outer end when so held, with the step mounted thereon, against the tree (FIG. 4) and the screw 30 is driven into the tree a substantial extent, sufficient for holding the step in position for further manipulation. With the handle still in position in the step, it is turned (FIG. 6) or cranked, clockwise, as indicated at 88, which turns the step about the axis of the screw and drives it fully into the tree. This turning movement is continued until the step solidly engages the tree, specifically at the inner end of the tread member (FIG. 5) and the lower end of the vertical second segment 31. The screw 30 is of substantial length, and of such size as to provide immense holding power. Reference is again made to the make-up and shape of the frame member 24. This frame member is made of a single, integral rod, bent as referred to, and thus the screw is an integral part of the entire rod and thus of extreme strength.

After the step is turned in to full position, the handle is detached and removed, merely by pressing the top button 85 and withdrawing the handle. He then uses the handle to put in place as many additional steps as he wishes, it being pointed out that this handle is a single element, as compared with a plurality of steps, the handle being used in mounting each and all of the steps. The steps may be left in position for as long as desired, such as in the case of a hunter using them, for a month or two, and then when the user desires to remove the steps, he merely reverses the maneuvers used in putting the steps in place, by performing a cranking operation on the handle, as indicated at 88.

I claim:

1. A tree climber step assembly comprising, a step and a handle for detachable connection together, the step including a bottom frame member and a top tread member secured together, the frame member including a first rod segment having a threaded free end at the top forming a screw for threading into a tree, the frame member having a second rod segment connected to the first rod segment, the frame member having a third rod segment connected to the second rod segment at the bottom of the latter extending oppositely from the first rod segment, the tread member including spaced side rod segments forming a space therebetween, and extending oppositely from the first rod segment, and the handle including a main bar extendible through said space in the tread member and detachably engageable with the third rod segment and thereby operable as a crank for turning the step about the axis of the screw for threading the screw into the tree and removing it therefrom.

2. A step assembly according to claim 1 wherein, the handle has an outer end and an inner end, and includes an inner main bar and an outer sleeve slidable on the inner end of the inner main bar, the handle is capable of having its inner end inserted through said space in the tread member and engageable with said third segment of the frame member, and the main bar and outer sleeve have interengaging elements operable upon relative sliding movement therebetween in response to engagement with said third segment for detachably connecting the handle with the step.

3. A step assembly according to claim 2 wherein, the bottom frame member includes a round bar constituting said third segment engageable by the handle, the inner ends of the main bar and outer sleeve constituting latching elements, one of the latching elements having a notch for receiving said third segment, the notch having a restricted inlet portion and a full inner portion, and the other latching element having locking element for locking said third segment against escaping from said notch.

4. A step assembly according to claim 3 and including, spring means for yieldingly moving the main bar and outer sleeve to unlatching position.

5. A step assembly according to claim 4 wherein, the locking element includes an inclined element wedging said latching segments into latching position.

6. A step assembly according to claim 4 wherein, the outer sleeve includes an extension extending into the interior of the main bar, and the main bar has an elongated slot receiving said extension, the main bar has a tab extending into its exterior, and said spring means is connected between said extension of the outer sleeve and said tab and being thereby entirely within the handle.

7. A step assembly according to claim 3 wherein, the main bar is tubular, the means for locking the latching means includes a spring member within the main bar, the spring member including a latch pushbutton extendable through the walls of the main bar and the outer sleeve, and also including a control pushbutton extending through the wall of the main bar to the exterior for manipulation by the user.

8. A step assembly according to claim 7 wherein, said spring member includes a hairpin spring having a pair of legs, and the pushbuttons are secured to one of said legs.

9. A step assembly according to claim 8 wherein, said spring member is free of securement with the handle except that provided by the pushbutton extending through the walls of the main bar and outer sleeve.

10. A step assembly according to claim 1 wherein, the step is composed entirely of round rods welded together.

11. A step assembly according to claim 1 wherein, the step in its usable position in-the tree has an inner end adjacent the tree, and an outer end, the bottom frame member is in a vertical plane, the screw, is horizontal in orientation, said second rod segment extends downwardly at an oblique angle relative to the first rod segment, the bottom frame member includes a third rod segment extending outwardly from the second rod segment, the bottom frame member includes a fourth rod segment extending diagonally outwardly and upwardly from the third rod segment, and the top tread member is secured at its ends to the frame member.

12. A step assembly according to claim 11 wherein,, the side rod segments of the top tread member have inturned end elements inwardly of the second segment spaced apart and forming a gap therebetween, and the top tread member is welded to the bottom frame member by weld material in said gap and engaging the bottom frame member and the top tread member.

13. A step assembly according to claim 12 wherein, the top tread member has anti slip projections thereon formed integrally with the material of the tread member.

14. A step assembly according to claim 11 wherein, the bottom frame member is constituted by a single rod bent to form said segments thereof, the top tread member is constituted by a single rod bent to form said spaced side rod segments, and the top tread member is secured at its opposite ends to the bottom frame member.

* * * * *